United States Patent [19]

Tezuka et al.

[11] Patent Number: 4,929,593

[45] Date of Patent: May 29, 1990

[54] THERMAL TRANSFER RECORDING MATERIAL

[75] Inventors: Toshiaki Tezuka; Kunihiro Koshizuka; Takao Abe, all of Hino, Japan

[73] Assignee: Konica Corporation, Tokyo, Japan

[21] Appl. No.: 386,784

[22] Filed: Jul. 28, 1989

[30] Foreign Application Priority Data

Aug. 2, 1988 [JP] Japan ..... 63-192981

[51] Int. Cl.[5] ..... B41M 5/26

[52] U.S. Cl. ..... 503/227; 428/195; 428/480; 428/484; 428/488.1; 428/488.4; 428/516; 428/520; 428/522; 428/913; 428/914; 428/472.1

[58] Field of Search ..... 428/195, 473.1, 480, 428/484, 488.1, 488.4, 516, 520, 522, 913, 914; 503/227

[56] References Cited

FOREIGN PATENT DOCUMENTS

| | | | |
|---|---|---|---|
| 215398 | 12/1983 | Japan | 503/227 |
| 3074693 | 4/1988 | Japan | 503/227 |
| 3221091 | 9/1988 | Japan | 503/227 |

*Primary Examiner*—Pamela R. Schwartz

*Attorney, Agent, or Firm*—Frishauf, Holtz, Goodman & Woodward

[57] ABSTRACT

A thermal transfer recording material is disclosed which comprises a combination of (i) a thermal transfer recording medium comprising a support and provided thereon a specific heat softening colorant layer and (ii) a recording sheet comprising a support and provided thereon a specific image-receiving layer, in which any one of the heat softening colorant layer and the image-receiving layer contains a curable polymer, and the other of them contains a curing agent. The thermal transfer recording material can form the printed image having superior abrasion resistance.

10 Claims, No Drawings

THERMAL TRANSFER RECORDING MATERIAL

FIELD OF THE INVENTION

The present invention relates to a thermal transfer recording material. More particularly, it relates to a thermal transfer recordinq material capable of forming a printed image with a superior abrasion resistance.

BACKGROUND OF THE INVENTION

In recent years, with wide spread of thermal transfer unites such as word processors, thermal transfer recording materials comprising a support and laminated thereon a heat softening layer have been widely employed.

Incidentally, printed images formed on a transferring paper or the like by using these thermal transfer recording materials are usually contain a heat softening substance together with a colorant.

The above printed images, however, which contains the heat softening substance, have had the disadvantage that they have so poor an abrasion resistance that images may get out of shapes when rubbed with fingers or the like.

Nowadays, the printed images are not only used only as mere prints, but also widely used as labels or the like, which are rubbed on many occasions, prepared by processing the printed images obtained by thermal transfer recording. In such instances, it has become more important to eliminate the above disadvantage.

SUMMARY OF THE INVENTION

The present invention was made on account of the above circumstances.

Namely, an object of the present invention is to provide a thermal transfer recording material capable of forming a printed image with a superior abrasion resistance.

The present inventors made intensive studies so that the above problem can be solved. As a result, they found that a thermal transfer recording material comprising a combination of (i) a thermal transfer recording medium comprising a support and provided thereon a specific heat softening colorant layer with (ii) a recording sheet comprising a support and provided thereon a specific image-receiving layer, can form the printed image having a superior abrasion resistance. The present invention has thus been accomplished.

The present invention provides a thermal transfer recording material, comprising a thermal transfer recording medium comprising a support (A) having thereon a heat softening colorant layer, and a recording sheet comprising a support (B) having thereon an image-receiving layer, in which any one of said heat softening colorant layer and said image-receiving layer contains a curable polymer, and the other of them contains a curing agent.

DETAILED DESCRIPTION OF THE INVENTION

The present invention is based on the principle that curing reaction is utilized to fix the colorant, thereby improving the abrasion resistance of printed images.

More specifically, the colorant transferred to the image-receiving layer is fixed with a cured polymer formed as a result of the reaction between the curable polymer and the curing agent.

Still more specifically, in the present invention, the curable polymer is incorporated in any one of the heat softening colorant layer of the thermal transfer recording medium and the image-receiving layer of the recording sheet and the curing agent is incorporated in the other of them, so that the heat softening colorant layer and image-receiving layer are brought into contact when the thermal transfer is effected. This contact brings about contact between the curable polymer and curing agent to cause the curing reaction between the both, so that the colorant is fixed on the surface of the image-receiving layer.

Thus, the thermal transfer recording material of the present invention comprises the combination of a specific thermal transfer recording medium with a specific recording sheet.

The thermal transfer recording medium and recording sheet according to the thermal transfer recording material of the present invention will be now described below.

Thermal transfer recording medium

The thermal transfer recording medium of the present invention comprises a support (A) and provided thereon a heat softening colorant layer containing any one of the curable polymer and curing agent.

The thermal transfer recording medium of the present invention may also have an additional layer or layers so long as its properties are not impaired. For example, the heat softening colorant layer may be laminated on the support (A) with an additional layer such as a peel layer held between them.

The constitution of the thermal transfer recording medium of the present invention will be described below in the order of the support (A) and the heat softening colorant layer.

Support (A)

The support (A) in the thermal transfer recording medium of the present invention may preferably have a good thermal resistant strength and also a high dimensional stability.

The material therefor includes, for example, polyethylene terephthalate.

The support (A) may have a thickness usually of not more than 30 μm, and preferably in the range of from 2 to 30 μm. A thickness more than 30 pm, of the support may resulting a lowering of thermal conductivity, causing a lowering of the quality of printed letters.

In the thermal transfer recording medium of the present invention, the back surface side of the support (A) may be of any constitution, and, for example, may be provided with a backing layer such as an anti-sticking layer.

On the support (A) as described above, formed is the heat softening colorant layer containing any one of the curable polymer and curing agent, as described below.

Heat softening colorant layer

There are no particular limitations on the curable polymer so long as it is a polymer curable as a result of reaction with the curing agent described later and the object of the present invention may not be hindered. It includes, for example, a copolymer of ethylene and vinyl acetate containing a hydroxyl group that reacts with an isocyanate group.

These curable polymer may also be used alone or in combination of two or more kinds.

The curable polymer may be contained in the heat softening colorant layer in the range usually of from 1 to 40% by weight, and preferably from 3 to 20% by weight, based on the total weight of a heat softening colorant layer composition.

In the present invention, the curing agent is incorporated in the heat softening colorant layer when the curable polymer is not incorporated therein.

Curing agents having been conventionally used as curing agents can be preferably used as the curing agent, including, for example, bifunctional isocyanates such as diphenylmethane diisocyanate, trifunctional isocyanates such as Colonate L (trade name; available from Nippon Polyurethane Industry Co., Ltd.), and urethane prepolymers containing isocyanate groups at both terminals of its molecule.

In the instance where the curing agent is used in the heat softening colorant layer, it may be used in the same amount as that in the case of the above curable polymer.

In addition to the above curable polymer and curing agent, the heat softening colorant layer contains at least a colorant and a hot-melting substance.

The colorant that can be used may be selected from inorganic pigments, organic pigments and dyes, including, for example, carbon black.

The colorant may be contained in the heat softening colorant layer in the range of usually from 5 to 40% by weight, and preferably from 10 to 30% by weight.

There are no particular limitations on the hot-melting substance so long as the object of the present invention may not be inhibited, but it may preferably include waxes having a melting point of from 50° to 100° C. when measured using a device of Yanagimoto MJP-2 Type.

The waxes may include, for example, paraffin wax.

The waxes may be used alone or in combination of two or more kinds.

The hot-melting substance may be contained in the heat softening colorant layer in the range of usually from 5 to 90% by weight, and preferably from 10 to 80% by weight, based on the total weight of a heat softening colorant layer composition.

The heat softening colorant layer may contain a thermoplastic resin such as an ethylene copolymer, a polyamide resin, a polyester resin or a polyurethane resin together with the hot melting substance and colorant.

The thermoplastic resin may be contained in the heat softening colorant layer in the range of usually from 1 to 40% by weight, preferably from 3 to 20% by weight, and more preferably from 5 to 15% by weight, based on the total weight of a heat softening colorant layer composition.

In addition to the above components, the heat softening colorant layer may also contain a surface active agent such as a compound containing a polyoxyethylene chain, for the purpose of controlling peel properties.

There can be also added inorganic or organic particles such as metallic powder and silica gel, or oils such as linseed oil and mineral oils.

The heat softening colorant layer can be provided by coating employing hot-melt coating, aqueous coating, or a coating method using an organic solvent.

The heat softening colorant layer provided by coating on the support (A) according to such coating methods has a layer thickness usually ranging from 0.3 to 8.0 μm, and preferably ranging from 0.5 to 6.0 μm.

After the heat softening colorant layer has been provided by coating in this way, it may be optionally passed through a drying step, a surface-smoothing step, etc., and is thereafter out into a desired shape. Thus, the thermal transfer recording medium according to the thermal transfer recording material of the invention can be obtained.

The present thermal transfer recording material can also be used by working it in the form of a sheet or tape.

Recording sheet

The recording sheet used in the present invention comprises a support (B) and provided thereon an image-receiving layer containing a curing agent or curable polymer.

The constitution of the recording sheet of the present invention will be described below in the order of the support (B) and the image-receiving layer.

Support (B)

The support (B) in the recording sheet of the resent invention may preferably be inexpensive and also have a good thermal resistant strength and a high dimensional stability.

The material therefor includes, for example, papers such as plain paper condenser paper, laminated paper, and coated paper. There are no particular limitations on the thickness of the support (B).

On the support (B) as described above, formed is the image-receiving layer containing the curable polymer or curing agent, as described below.

Image-receiving layer

In the present invention, the curing agent is incorporated in the image receiving layer when the curable polymer is incorporated in the heat softening colorant layer.

On the other hand, the curable polymer is incorporated in the image-receiving layer when the curing agent is incorporated in the heat softening colorant layer.

The types of the curable polymer and curing agent incorporated in the image-receiving layer may be the same as those already described in the paragraph "-Heat softening colorant layer -".

In addition to the curable polymer or curing agent at least a thermoplastic substance for dispersing these components is incorporated in the image-receiving layer.

There are no particular limitations on the thermoplastic substance so long as it does not react with the curing agent or curable polymer and may not inhibit the object of the present invention. It may include, for example, polyester.

The curable polymer or curing agent in the image-receiving layer may be used in an amount of usually from 5 to 90% by weight, preferably from 10 to 80% by weight, based on the total weight of a heat softening colorant layer composition.

The image-receiving layer can be provided by coating employing hot-melt coating, aqueous coating, or a coating method using an organic solvent.

The image-receiving layer provided by coating on the support (B) according to such coating methods has a layer thickness usually ranging from 0.5 to 100 μm, and preferably ranging from 1 to 20 μm.

After the image receiving layer has been provided by coating in this way, it may be optionally passed through a drying step, a surface-smoothing step, etc., and is thereafter out into a desired shape. Thus, the recording sheet according to the thermal transfer recording material of the invention can be obtained.

In the present invention, in the instance where the curable polymer is incorporated in the heat softening colorant layer of the thermal transfer recording medium, the curing agent is incorporated in the image-receiving layer of the recording sheet. On the other hand, in the instance where the curing agent is incorporated in the above heat softening colorant layer, the curable polymer is incorporated in the above image-receiving layer. Combinations of these curable polymers and curing agents are as follows, in addition to the above-described.

| | Curable polymer | Curing agent |
|---|---|---|
| (A) | Epoxy resins | Thionylamines |
| (B) | Epoxy resins | Polyamide resins |
| (C) | Epoxy resins | Nylon resins |
| (D) | Epoxy resins | Polysulfide resins |
| (E) | Epoxy resins | Silicones |
| (F) | Epoxy resins | Nitrile rubbers (a copolymer of butadiene and acrylonitrile |
| (G) | Epoxy resins | Isocyanate compounds |
| (H) | Phenol resins | Thermoplastic vinyl resins |
| (I) | Phenol resins | Nitrile rubbers |
| (J) | Phenol resins | Polychloroprene |
| (K) | Phenol resins | Polyacetal resins such as polyvinyl alcohol and polyvinyl butyral |
| (L) | Phenol resins | Polyamide resins |
| (M) | Polyester resins | Isocyanate compounds |
| (N) | Polyester resins | Epoxy resins |
| (O) | Polyoxyethylene resins | Epoxy resins |
| (P) | Polyurethanes | Isocyanate compounds |

The termal transfer process in which the present thermal transfer recording material is used has no particular difference from conventional thermal transfer recording processes, and will now be described taking an example in which a thermal head, which is most typical as a heat source, is used.

First, the heat softening colorant layer of the thermal transfer recording medium and the image-receiving layer of the recording sheet are brought into close contact. Heat pulses are applied by means of the thermal head while heat pulses are further optionally applied from the back surface of the recording sheet by means of a platen, and thus the heat softening colorant layer is locally heated at the part corresponding to an intended printed letter or transfer pattern.

The heated part on the heat softening colorant layer, at which the temperature is raised, is immediately softened and transferred onto the image-receiving layer of the recording sheet.

At this stage, because of the heat softening colorant layer containing the curable polymer or curing agent as described above and the image-receiving layer also containing the curing agent or curable polymer, the printed image formed on the recording sheet comes to possess a heat-cured polymer and have a superior abrasion resistance.

EXAMPLES

The present invention will be described below in greater detail by giving Example and Comparative Example of the present invention.

Example 1

(a) Preparation of thermal transfer recording medium:

A polyethylene terephthalate film of 6 μm thick was coated thereon with the following heat softening colorant layer composition so as to have a dried film thickness of 4 μm. A heat softening colorant layer was thus formed.

The coating was carried out employing a hot-melt method using a gravure coater.

| Heat softening colorant layer composition | |
|---|---|
| Paraffin wax | 55 parts by weight |
| Ester wax | 15 parts by weight |
| Ethylene-vinyl acetate copolymer | 15 parts by weight |
| Carbon black | 15 parts by weight |

(b) Preparation of recording sheet:

A mirror coated paper of 30 μm thick was coated thereon with the following image-receiving layer composition so as to have a dried film thickness of 4 μm, to form an image-receiving layer.

The coating was carried out employing a solvent coating method using a gravure coater.

Used as the above solvent were 450 parts by weight of methyl ethyl ketone and 450 parts by weight of toluene based on 100 parts by weight of the following image receiving layer composition.

| Image-receiving layer composition | |
|---|---|
| Polyester | 60 parts by weight |
| Diphenylmethane diisocyanate | 40 parts by weight |

Using the resulting thermal transfer recording material, printed images were next formed in the following manner and the abrasion resistance thereof was also evaluated.

Abrasion resistance

The thermal transfer recording material was loaded on a commercially available printer (a 24-dot serial head; applied energy: 30 mJ/head). The printer was set to have a platen pressure of 700 g/head and a print speed of 50 cm/sec, under conditions of which transfer of alphabets (i.e., printing) was carried out.

Subsequently a load of 20 g/cm$^2$ was applied to the cured printed images through a conventional corrugated fiberboard paper, under the state of which the printed images were rubbed 10 times.

The printed images thus rubbed were observed to make evaluation of abrasion resistance.

As a result, no changes were seen on the printed images.

Comparative Example 1

The same thermal transfer recording medium as that of Example 1 was loaded on a commercially available printer a 24-dot serial head; applied energy: 30 mJ/head). The printer was set to have a platen pressure of 700 g/head and a print speed of 50 cm/sec, under conditions of which transfer of alphabets (i.e., printing) was carried out on SPIKABOND (trade name) paper. This SPIKABOND PAPER is a plain paper, in which, needless to say, no image-receiving layer is formed.

A load of 20 g/cm$^2$ was applied to the cured printed images through a conventional corrugated fiberboard paper, under the state of which the printed images were rubbed 10 times.

The printed images thus rubbed were observed to make evaluation of abrasion resistance.

As a result, it turned impossible to make out the printed images.

Example 2

(a) preparation of thermal transfer recording medium:

A polyethylene terephthalate film of 6 μm thick was coated thereon with the following heat softening colorant layer composition so as to have a dried film thickness of 4 μm. A heat softening colorant layer was thus formed.

The coating was carried out employing a hot-melt method using a gravure coater.

| Heat softening colorant layer composition | |
|---|---|
| Paraffin wax | 55 parts by weight |
| Ester wax | 15 parts by weight |
| Ethylene-vinyl acetate copolymer | 15 parts by weight |
| Carbon black | 15 parts by weight |

(b) Preparation of recording sheet:

A mirror coated paper of 30 μm thick was coated thereon with the following image-receiving layer composition so as to have a dried film thickness of 4 μm, to form an image-receiving layer.

The coating was carried out employing a solvent coating method using a gravure coater.

Used as the above solvent were 450 parts by weight of methyl ethyl ketone and 450 parts by weight of toluene based on 100 parts by weight of the following image-receiving layer composition.

| Image-receiving layer composition | |
|---|---|
| Polyester | 60 parts by weight |
| Phenolic resin | 40 parts by weight |

Using the resulting thermal transfer recording material, printed images were next formed in the following manner and the abrasion resistance thereof was also evaluated.

Abrasion resistance

The thermal transfer recording material was loaded on a commercially available printer a 24-dot serial head; applied energy: 30 mJ/head). The printer was set to have a platen pressure of 700 g/head and a print speed of 50 cm/sec, under conditions of which transfer of alphabets (i.e., printing) was carried out.

Subsequently a load of 20 g/cm$^2$ was applied to the cured printed images through a conventional corrugated fiberboard paper, under the state of which the printed images were rubbed 10 times.

The printed images thus rubbed were observed to make evaluation of abrasion resistance.

As a result, no changes were seen on the printed images.

What is claimed is:

1. A thermal transfer recording material, comprising a thermal transfer recording medium comprising a support (A) having thereon a heat softening colorant layer and a recording sheet comprising a support (B) having thereon an image-receiving layer, in which one of said heat softening colorant layer and said image-receiving layer contains a curable polymer, and the other of them contains a curing agent capable of curing said curable polymer.

2. The material of claim 1, wherein said heat softening colorant layer contains both of a colorant and a hot-melting substance.

3. The material of claim 2, wherein said colorant is at least one of inorganic pigments, organic pigments and dyes.

4. The material of claim 2, wherein said hot-melting substance is a wax having a melting point of from 50° to 100° C.

5. The material of claim 1, wherein said curable polymer is a copolymer of ethylene and vinyl acetate.

6. The material of claim 1, wherein said heat softening colorant layer contains said curable polymer or said curing agent in an amount of from 1 to 40% by weight based on the total weight of the components of said heat softening colorant layer.

7. The material of claim 1, wherein said curing agent is a bifunctional isocyanate, a trifunctional isocyanate or a urethane prepolymer having isocyanate groups at both terminals of its molecule.

8. The material of claim 1, wherein said image-receiving layer contains said curable polymer or said curing agent in an amount of from 5 to 90% by weight based on the total weight of the components of said image-receiving layer.

9. The material of claim 1, wherein said image-receiving layer contains a thermoplastic substance.

10. The material of claim 9, wherein said thermoplastic substance is a ethylene copolymer, a polyamide or a polyester.

* * * * *